US006572260B2

(12) United States Patent
Knight

(10) Patent No.: US 6,572,260 B2
(45) Date of Patent: Jun. 3, 2003

(54) MIXER APPARATUS FOR MIXING MATERIALS SUCH AS FEED

(75) Inventor: William S. Knight, Brodhead, WI (US)

(73) Assignee: Kuhn Knight Inc., Brodhead, WI (US)

( * ) Notice: Subject to any disclaimer, the term of this patent is extended or adjusted under 35 U.S.C. 154(b) by 0 days.

(21) Appl. No.: 09/865,203

(22) Filed: May 24, 2001

(65) Prior Publication Data

US 2002/0176321 A1 Nov. 28, 2002

(51) Int. Cl.[7] ..... B01F 7/24

(52) U.S. Cl. ..... 366/314; 366/601; 366/603

(58) Field of Search ..... 366/64–66, 297, 366/300, 314, 318, 319, 322, 323, 601, 603; 241/101.76, 101.761, 101.762, 101.763, 101.77

(56) References Cited

U.S. PATENT DOCUMENTS 4,363,427 A * 12/1982 Crosby
5,020,918 A * 6/1991 Faccia
5,076,704 A * 12/1991 Serbousek
5,082,188 A * 1/1992 Urich
5,462,354 A * 10/1995 Neier

FOREIGN PATENT DOCUMENTS

EP 0 706 755 A1 * 4/1996
EP 0 779 027 A2 * 6/1997

* cited by examiner

*Primary Examiner*—Charles E. Cooley
*Assistant Examiner*—David Sorkin
(74) *Attorney, Agent, or Firm*—David J. Archer

(57) ABSTRACT

A mixer apparatus for mixing materials such as feed is disclosed. The apparatus includes a container for the reception therein of the materials. The container has a base and a wall extending away from the base, the wall defining an opening disposed remote from the base for the reception therethrough of the materials. The arrangement is such that the base and the wall define therebetween an enclosure for the materials received through the opening. An auger is rotatably disposed within the enclosure, the auger having an axis of rotation extending through the base. A driven wheel is drivingly connected to the auger, the driven wheel being disposed on an opposite side of the base relative to the auger. A drive connected to a main source of power, the drive being drivingly connected to the driven wheel so that when the drive rotates, the auger is rotated within the enclosure for mixing the materials. An auxiliary driver is drivingly connected to the driven wheel for augmenting rotation of the auger particularly during a commencement of a mixing operation when additional power is required to rotate the auger and towards the end of the discharge operation so that removal of a residue of the materials disposed on the auger is facilitated. The apparatus includes an over running device associated with the main source of power and the auxiliary driver for enabling the overrun of the main source of power when the auxiliary driver is engaged and for enabling the overrun of the auxiliary driver when the auger is being rotated by the main source of power only.

25 Claims, 4 Drawing Sheets

MIXER APPARATUS FOR MIXING MATERIALS SUCH AS FEED

BACKGROUND OF THE INVENTION

1. Field of the Invention

The present invention relates to a mixer apparatus for mixing materials such as feed. More specifically, the present invention relates to a mixer apparatus having a vertical auger for mixing materials such as feed.

2. Background Information

Particularly, in raising livestock and dairy farming, different feeds are mixed together. Typically, when feed is mixed, considerable horsepower is required.

Because of such power requirements, many mixers include variable speed gearboxes so that the auger can turn more slowly until the feed has been mixed. Subsequently, the rotational speed of the mixing auger is increased by varying the gearbox ratio. However, such variable speed gearboxes are expensive.

As an alternative, in the prior art, various mechanical linkage gearboxes have been proposed in which gear ratios are selected manually by means of a manually operated lever. However, such gearboxes have been difficult to operate and have usually required stopping the mixing process while the lever is moved to select a different gear ratio.

Another problem that has presented itself in the process of mixing feed and similar materials is towards the end of the operation. More particularly, when the mixed materials have been blended and discharged from the mixer container, a considerable quantity of materials are left in the mixer container attached to the auger or augers.

In the prior art, hydrostatic drives have been proposed and these generally serve both the mixing requirements and the cleanout process. However, such hydrostatic systems are extremely expensive being in the region of $20,000 and are excessively complicated and tend to be troublesome particularly in feed mixing environments due to heat and contamination problems.

Consequently, in U.S. Pat. No. 5,020,918 to Faccia, a mixer apparatus is disclosed in which an auxiliary hydraulic motor is provided for increasing the rotational speed of the auger at the end of the mixing operation so that any materials left on the auger flights are thrown by centrifugal force outwardly to the walls of the container and from there through the discharge outlet.

However in the aforementioned U.S. Pat. No. 5,020,918, the hydraulic motor is supported on rails so that when the auxiliary hydraulic motor is to be employed, the main drive must be disengaged so that rotation of the auger stops. The hydraulic motor is then moved into driving engagement by sliding the motor along the rails into engagement with the auger. Subsequently, with the main drive disengaged, the auxiliary drive increases the speed of rotation of the auger such that removal of the residual materials is accomplished. Clearly, the stopping of the mixing and discharge operation in order to connect the auxiliary drive is a distinct disadvantage of the above proposal.

The present invention overcomes the problem associated with the U.S. Pat. No. 5,020,918 arrangement by providing a hydraulic or like motor which can be energized not only during a discharge operation but also during the mixing process or at any time as a boost to the mixing operation. The present invention provides an over running device associated with the main drive and the auxiliary drive so that the auxiliary drive can be employed without stopping the mixing or discharge operations.

Therefore, it is a primary feature of the present invention to provide a mixer apparatus which overcomes the aforementioned problems associated with the prior art mixer apparatus and which provides a significant contribution to the art of mixing materials such as feed.

Another feature of the present invention is the provision of a mixer apparatus that reduces the cost of manufacture thereof.

A further feature of the present invention is the provision of a mixer apparatus that permits cleanout of a mixer container without having to stop rotation of a mixing auger.

Another feature of the present invention is the provision of a mixer apparatus that enhances the mixing of materials such as feed and the like.

Yet another feature of the present invention is the provision of a mixer apparatus that assists in the cleaning of the augers after a mixing operation.

Throughout the description of the various embodiments of the present invention, the term mixing device, auger or augers is to be understood to include paddle arrangements and that the flighting includes screw and/or helix type arrangements which may be continuous or non-continuous and would include segmented augers. Also, throughout the description and claims of the present invention, the term materials such as feed and the like is to be understood as including composts and other materials that require mixing.

Furthermore, throughout the description and claims, although the present invention is described relative to a vertical auger mixer, the inventive concept of the present invention could also be applied to a horizontal mixer having one or more augers.

Other features and advantages of the mixer apparatus according to the present invention will be readily apparent to those skilled in the art by a consideration of the detailed description contained herein of a preferred embodiment of the present invention.

SUMMARY OF THE INVENTION

The present invention relates to a mixer apparatus for mixing materials such as feed. The apparatus includes a container for the reception therein of the materials. The container has a base and a wall extending away from the base, the wall defining an opening disposed remote from the base for the reception therethrough of the materials. The arrangement is such that the base and the wall define therebetween an enclosure for the materials received through the opening. An auger is rotatably disposed within the enclosure, the auger having an axis of rotation extending through the base. A drive connected to a main source of power, is drivingly connected to the auger so that when the drive rotates, the auger is rotated within the enclosure for mixing the materials. An auxiliary driver is drivingly connected to the auger for augmenting rotation of the auger while the auger is being rotated by the main source of power.

More specifically, a driven wheel is drivingly connected to the auger, the driven wheel being disposed on an opposite side of the base relative to the auger. The auxiliary driver is drivingly connected to the driven wheel for augmenting rotation of the auger particularly during a commencement of a mixing operation when additional power is required to rotate the auger and towards an end of the discharging operation so that removal of a residue of the materials disposed on the auger is facilitated. The apparatus includes an over running device associated with the main source of power and the auxiliary driver for enabling the over run of the main source of power when the auxiliary driver is engaged and for enabling the over run of the auxiliary driver when the auger is being rotated by the main source of power only.

In a more specific embodiment of the present invention, the base includes an upstanding hub having a first and a second extremity. A drive shaft extends through the hub, the drive shaft having a first and a second end. The first end of the drive shaft is secured to the driven wheel while the second end of the drive shaft is secured to the auger so that the drive shaft transmits rotation of the drive to the auger. A bearing plate is secured to the second extremity of the hub, the bearing plate defining an aperture for bearingly supporting the second end of the drive shaft.

Also, the wall slopes outwardly away from the base and defines an outlet for the discharge therethrough of the materials when mixed.

Furthermore, the axis of rotation of the auger is vertical and the driven wheel and the auger rotate about the axis of rotation.

Additionally, the driven wheel defines a plurality of equidistantly spaced plain gear teeth disposed circumferentially around the driven wheel.

Moreover, the drive rotates about a rotational axis which is disposed spaced and parallel to the axis of rotation of the auger.

The drive defines a further plurality of gear teeth which drivingly intermesh with the gear teeth of the driven wheel.

The apparatus further includes a gearbox which has an input and an output, the output being connected to the drive. Also, a driveline is provided which has a first and a second end, the second end of the driveline being connected to the input of the gearbox.

Additionally, the auxiliary driver is a hydraulic motor. The hydraulic motor includes an output shaft which augments rotation of the auger during operation of the hydraulic motor.

In one embodiment of the present invention, the output shaft of the hydraulic motor is connected to the input of the gearbox.

In another embodiment of the present invention, a gearwheel is secured to the output shaft of the hydraulic motor, the gearwheel intermeshing with the gear teeth of the driven wheel. Furthermore, the over running device includes an over running clutch which is drivingly disposed between the second end of the driveline and the input of the gearbox so that when the auxiliary driver supplies power to the driven wheel in excess of the power supplied by the main source of power, the over running clutch allows the power from the auxiliary driver to be transmitted to the driveline.

Additionally, the over running device includes a mechanism such as a hydraulic valve which permits the auxiliary driver to spool when the auger is being rotated by the main source of power only.

More specifically, the hydraulic motor includes a motoring valve.

Alternatively, the hydraulic motor includes a closed circuit hydraulic system and an over running one way drive clutch mechanism.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
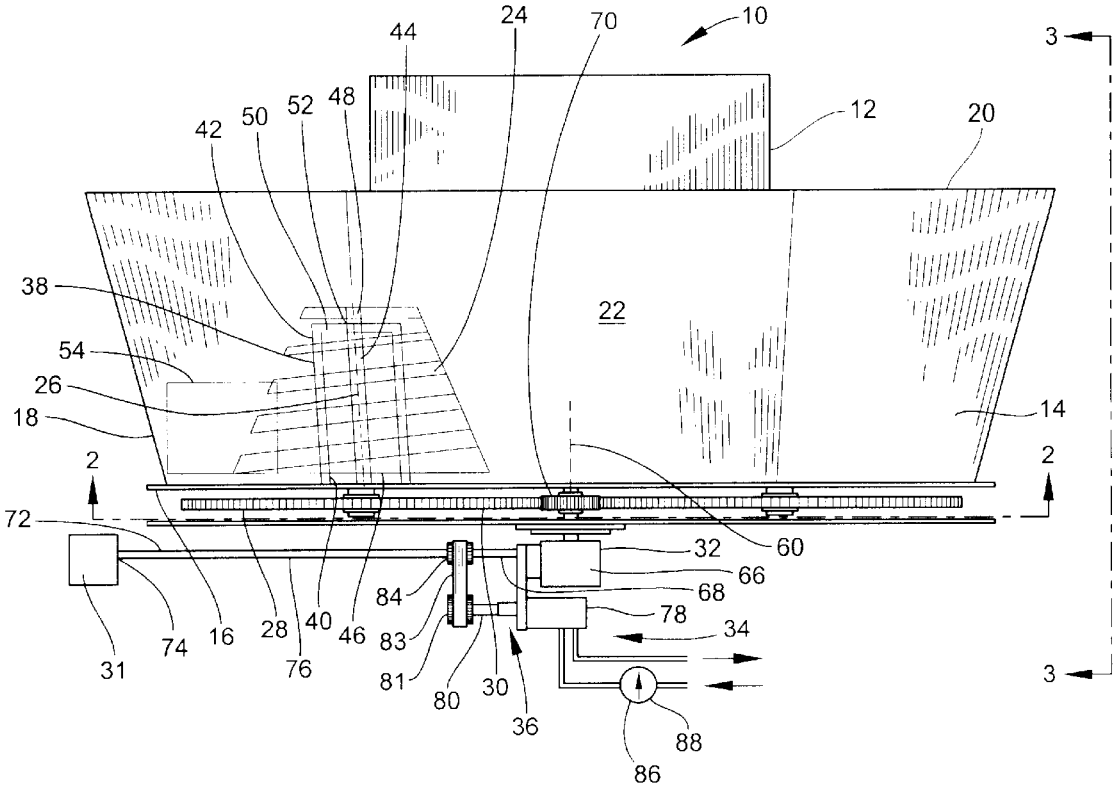
FIG. 1 is a side elevational view of the mixer apparatus according to the present invention.

FIG. 1 is a side elevational view of a mixer apparatus generally designated 10 according to the present invention. As shown in FIG. 1, the mixer apparatus 10 is used for mixing materials 12 such as a bale of feed. The apparatus 10 includes a container 14 for the reception therein of the materials 12. The container 14 has a base 16 and a wall 18 extending away from the base 16, the wall 18 defining an opening 20 disposed remote from the base 16 for the reception therethrough of the materials 12. The arrangement is such that the base 16 and the wall 18 define therebetween an enclosure 22 for the materials 12 received through the opening 20.

Figure 2:
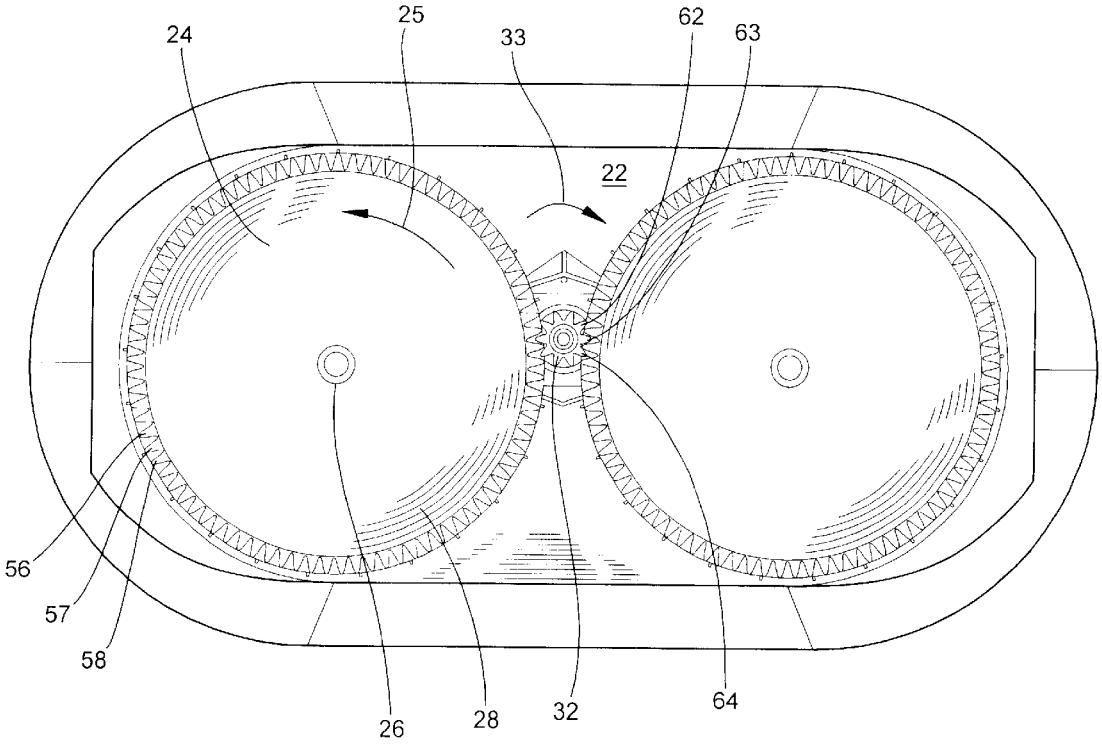
FIG. 2 is a view taken on the line 2—2 of FIG. 1.

FIG. 2 is a view taken on the line 2—2 of FIG. 1. As shown in FIGS. 1 and 2, an auger 24 is rotatably disposed within the enclosure 22 as indicated by the arrow 25, the auger 24 having an axis of rotation 26 extending through the base 16. A driven wheel 28 is drivingly connected to the auger 24, the driven wheel 28 being disposed on an opposite side 30 of the base 16 relative to the auger 24. A drive 32 connected to a main source of power 31, such as a power take off (PTO) of a tractor, is drivingly connected to the driven wheel 28 so that when the drive 32 rotates, as indicated by the arrow 33, the auger 24 is rotated within the enclosure 22 for mixing the materials 12. An auxiliary driver generally designated 34 is drivingly connected to the driven wheel 28 for augmenting rotation of the auger 24 particularly during a commencement of a mixing operation when additional power is required to rotate the auger 24 and towards an end of the mixing operation so that removal of a residue of the materials disposed on the auger 24 is facilitated. The apparatus 10 includes an over running device generally designated 36 associated with the main source of power 31 and the auxiliary driver 34 for enabling the overrun of the main source of power 31 when the auxiliary driver 34 is engaged and for enabling the overrun of the auxiliary driver 34 when the auger 24 is being rotated by the main source of power 31 only.

In a more specific embodiment of the present invention as shown particularly in FIG. 1, the base 16 includes an upstanding hub 38 having a first and a second extremity 40 and 42 respectively. A drive shaft 44 extends through the hub 38, the drive shaft 44 having a first and a second end 46 and 48 respectively. The first end 46 of the drive shaft 44 is secured to the driven wheel 28 and the second end 48 of the drive shaft 44 is secured to the auger 24 so that the drive shaft 44 transmits rotation of the drive 32 to the auger 24. A bearing plate 50 is secured to the second extremity 42 of the hub 38, the bearing plate 50 defining an aperture 52 for bearingly supporting the second end 48 of the drive shaft 48.

Also, the wall 18 slopes outwardly away from the base 16 and the wall 18 defines an outlet 54 for the discharge therethrough of the materials 12 when mixed.

Furthermore, the axis of rotation 26 of the auger 24 is vertical and the driven wheel 28 and the auger 24 rotate about the axis of rotation 26.

Additionally, as shown particularly in FIG. 2, the driven wheel 28 defines a plurality of equidistantly spaced plain gear teeth 56, 57 and 58 disposed circumferentially around the driven wheel 28.

Moreover, the drive 32 rotates about a rotational axis 60 which is disposed spaced and parallel to the axis of rotation 26 of the auger 24.

As shown in FIG. 2, the drive 32 defines a further plurality of gear teeth 62, 63 and 64 which drivingly intermesh with the gear teeth 56–58 of the driven wheel 28.

As shown in FIG. 1, the apparatus 10 further includes a gearbox 66 which has an input and an output 68 and 70 respectively, the output 70 being connected to the drive 32. Also, a driveline 72 is provided which has a first and a second end 74 and 76 respectively, the second end 76 of the driveline 72 being connected to the input 68 of the gearbox 66.

Figure 3:
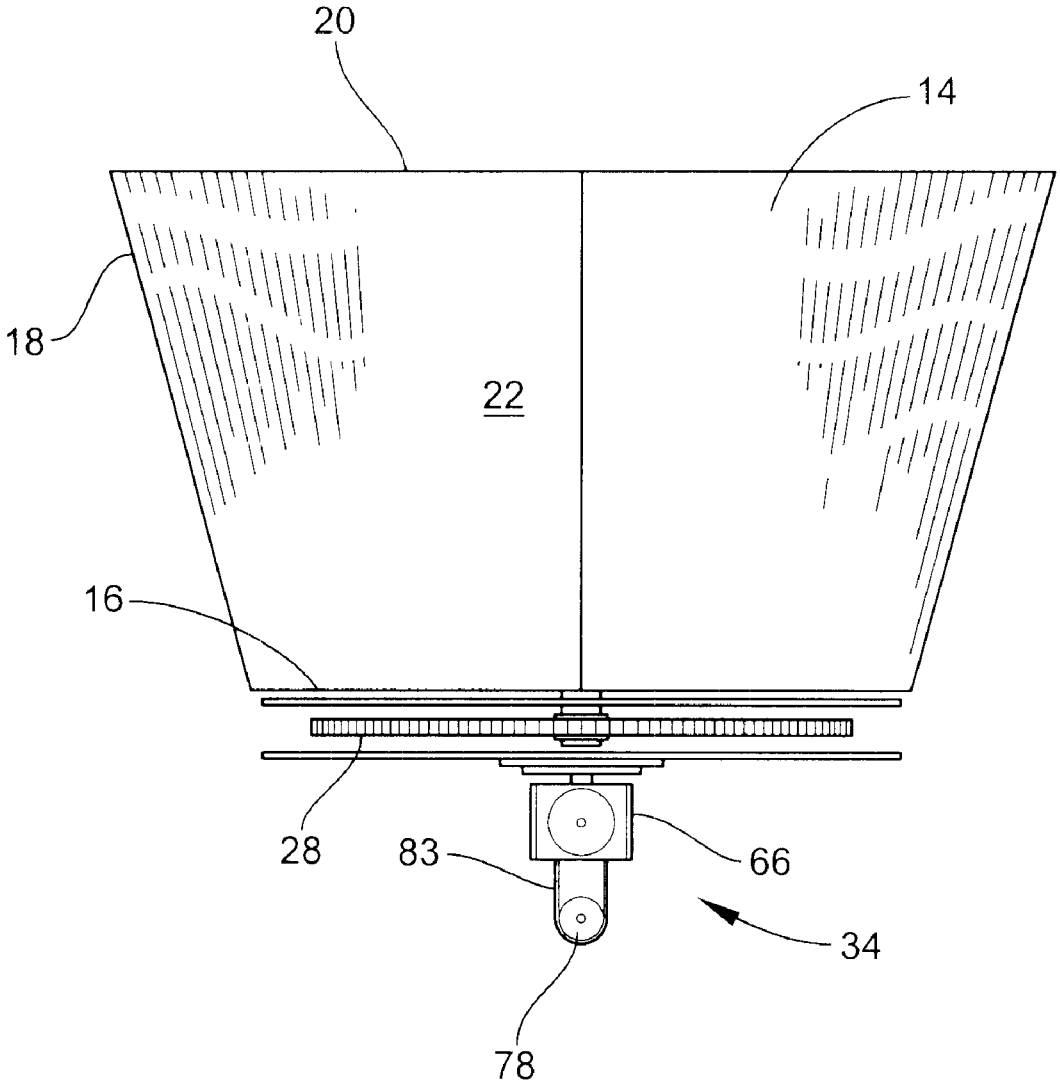
FIG. 3 is a view taken on the line 3—3 of FIG. 1.

FIG. 3 is a view taken on the line 3—3 of FIG. 1. As shown in FIG. 3, the auxiliary driver 34 is a hydraulic motor 78. The hydraulic motor 78 includes an output shaft 80, as shown in FIG. 1, which augments rotation of the auger 24 during operation of the hydraulic motor 78.

More specifically, the output shaft 80 drives a pulley 81 which in turn drives a belt 83. The belt 83 drives a one way clutch 84.

In one embodiment of the present invention, as shown in FIG. 1, the output shaft 80 of the hydraulic motor 78 is connected to the input 68 of the gearbox 66.

Figure 4:
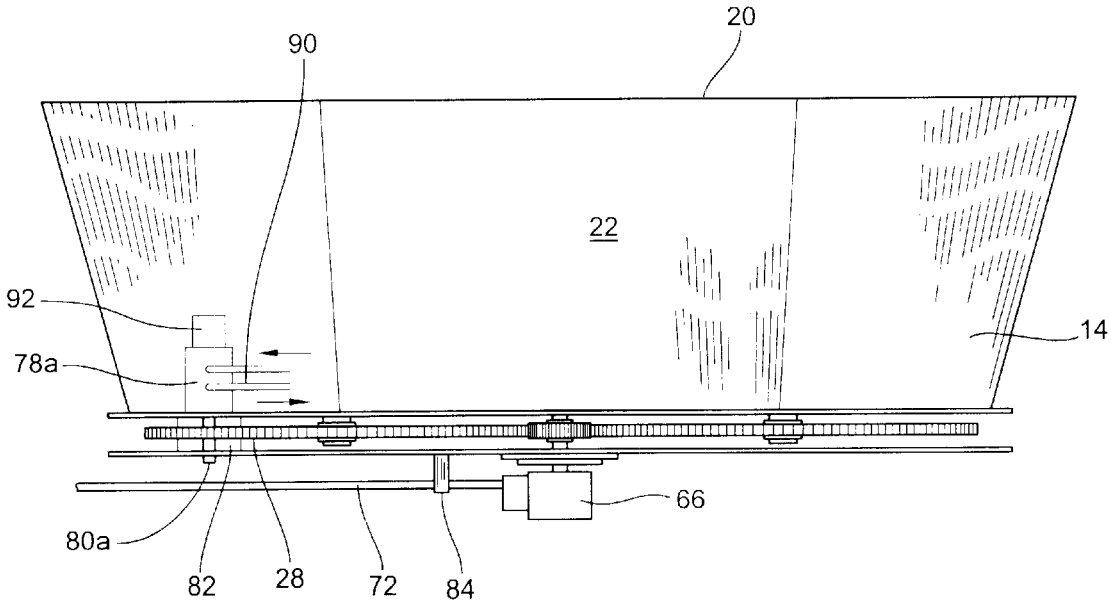
FIG. 4 is a similar view to that shown in FIG. 1 but shows another embodiment of the present invention.

FIG. 4 is a similar view to that shown in FIG. 1 but shows another embodiment of the present invention. As shown in FIG. 4, a gearwheel 82 is secured to an output shaft 80*a* of a hydraulic motor 78*a*. The gearwheel 82 intermeshes with the gear teeth 56–58 of the driven wheel 28 shown in FIG. 2.

Furthermore, as shown in FIG. 1, the over running device 36 includes an over running clutch 84 which is drivingly disposed between the second end 76 of the driveline 72 and the input 68 of the gearbox 66 so that when the auxiliary driver 34 supplies power to the driven wheel 28 in excess of the power supplied by the second end 76 of the driveline 72, the over running clutch 84 allows the power from the auxiliary driver to be transmitted to the driveline 72.

Additionally, the over running device 36 includes a mechanism 86 which permits the auxiliary driver 34 to spool when the auger 24 is being rotated by the driveline 72 only.

More specifically, the hydraulic motor 78 includes a valve 88. The hydraulic valve 88 is selectively movable between an on and an off position thereof, so that when the valve 88 is set in the off position, the hydraulic motor 78 is able to free wheel.

Alternatively, as shown in FIG. 4, the hydraulic motor 78*a* includes a closed circuit hydraulic system 90 and an over running one way drive clutch mechanism 92.

In operation of the arrangement shown in FIGS. 1–3, a bale of feed or like material 12 is lowered through opening 20 into the enclosure 22. The auger is rotated by means of the driveline 72 which is connected at the first end thereof to the main source of power 31 which is a power take off of a tractor. Thus, the second end of the driveline which is connected to the input 68 of the gearbox 66 causes rotation of the output 68 of the gearbox which drives the drive 32. Rotation of the drive 32 causes rotation of the driven wheel 28 and also another driven wheel in the case of a twin auger mixer as shown. As the driven wheel 28 is rotated, such rotation is transmitted to the auger 24 by means of the drive shaft 44.

However, rotation of the auger 24 is augmented by power supplied to the driven wheel 24 by means of the auxiliary hydraulic motor 78 which is driven by a supply of hydraulic fluid from a hydraulic supply connection on the tractor. The hydraulic supply on most tractors supplies hydraulic fluid at up to 2500 psi for driving ancillary equipment. Therefore, particularly at start up, when extra power is required to move the materials within the enclosure, such additional power is supplied by the hydraulic motor which applies further torque to the gearbox 66.

Nevertheless, when the aforementioned supplementary power is being applied to the gearbox 66 for cleaning out the enclosure 22, there could be a tendency to cause rotation of the first end 74 of the driveline 72 at a greater speed than that supplied by the power take off (PTO). Such greater speed will be limited by the PTO connection. The present invention therefore provides the one way clutch arrangement 84 so that only the input 68 of the gearbox 66 receives such greater rotational speed for causing dislodgement of materials from the auger 24.

Also, when during a mixing operation following a start up and prior to a cleaning out of the container 14, the hydraulic motor could be set so as not to supply power to the auger. Therefore, in order to isolate the hydraulic motor from the rotational power supplied by the PTO, the hydraulic motor is supplied with the spooling mechanism 86 which permits hydraulic fluid to be pumped to the hydraulic motor and returned via a return hose without rotating the output shaft 80 of the hydraulic motor so that the output shaft is permitted to freely rotate driven by the driveline 72.

In the alternative arrangement shown in FIG. 4, the hydraulic motor 78*a* is drivingly connected directly with the driven wheel 28 via the gearwheel 82 secured to the output shaft 80*a* of the hydraulic motor 78*a*. In the arrangement of FIG. 4, a one way clutch 84 is similarly provided on the driveline 72 for over run of the PTO connection and the one way clutch 92 is supplied to protect the hydraulic motor 78*a* when not in use.

The present invention provides a unique arrangement in which auxiliary power can be controllably supplied to assist in a mixing operation without the need for interrupting a mixing operation.

What is claimed is:

1. A mixer apparatus for mixing feed materials, said apparatus comprising:

a container for the reception therein of the materials;

said container including:

a base;

a wall extending away from said base, said wall defining an opening disposed remote from said base for the reception therethrough of the materials, the arrangement being such that said base and said wall define therebetween an enclosure for the materials received through said opening;

an auger rotatably disposed within said enclosure;

a drive connected to a main source of power, said drive being drivingly connected to said auger;

an auxiliary driver selectively connected to said drive for augmenting rotation of said auger while said auger is being rotated by said main source;

a driven wheel drivingly connected to said auger;

said drive being drivingly connected to said driven wheel so that when said drive rotates, said auger is rotated within said enclosure for mixing the materials;

said auxiliary driver being drivingly connected to said driven wheel for augmenting rotation of said auger particularly during a commencement of a mixing operation when additional power is required and to increase a rotational speed of said auger towards an end of a discharge operation so that removal of a residue of the materials disposed on said auger is facilitated; and an over running device associated with the main source of power and said auxiliary driver for enabling over run of the main source of power when said auxiliary driver is engaged and for enabling over run of said auxiliary driver when said auger is being rotated by the main source of power only.

2. A mixer apparatus for mixing materials as set forth in claim 1 wherein said base includes:

an upstanding hub having a first and a second extremity;

a drive shaft extending through said hub, said drive shaft having a first and a second end, said first end of said drive shaft being secured to said driven wheel, said second end of said drive shaft being secured to said auger so that said drive shaft transmits rotation of said drive to said auger;

a bearing plate secured to said second extremity of said hub, said bearing plate defining an aperture for bearingly supporting said second end of said drive shaft.

3. A mixer apparatus for mixing materials as set forth in claim 1 wherein said wall slopes outwardly away from said base.

4. A mixer apparatus for mixing materials as set forth in claim 1 wherein said wall defines an outlet for the discharge therethrough of the materials when mixed.

5. A mixer apparatus for mixing materials as set forth in claim 1 wherein said axis of rotation of said auger is vertical.

6. A mixer apparatus for mixing materials as set forth in claim 1 wherein said driven wheel and said auger rotate about said axis of rotation.

7. A mixer apparatus for mixing materials as set forth in claim 1 wherein said driven wheel defines a plurality of equidistantly spaced plain gear teeth disposed circumferentially around said driven wheel.

8. A mixer apparatus for mixing materials as set forth in claim 7 wherein said drive rotates about a rotational axis disposed spaced and parallel to said axis of rotation of said auger;

said drive defining a further plurality of gear teeth which drivingly intermesh with said gear teeth of said driven wheel.

9. A mixer apparatus for mixing materials as set forth in claim 8 further including:

a gearbox having an input and an output, said output being connected to said drive.

10. A mixer apparatus for mixing materials as set forth in claim 9 wherein said auxiliary driver is a hydraulic motor;

said hydraulic motor including:

an ouput shaft which augments rotation of said auger during operation of said hydraulic motor.

11. A mixer apparatus for mixing materials as set forth in claim 10 wherein said output shaft of said hydraulic motor is drivingly connected to said input of said gearbox.

12. A mixer apparatus for mixing materials as set forth in claim 10 further including:

a gearwheel secured to said output shaft of said hydraulic motor, said gearwheel intermeshing with said gear teeth of said driven wheel.

13. A mixer apparatus for mixing materials as set forth in claim 9 wherein said over running device includes:

an over running clutch drivingly attached to said input of said gearbox so that when said auxiliary driver supplies power to said driven wheel, said over running clutch enables overrun of the main power source.

14. A mixer apparatus for mixing materials as set forth in claim 1 wherein said drive rotates about a rotational axis disposed spaced and parallel to said axis of rotation of said auger.

15. A mixer apparatus for mixing materials as set forth in claim 1 wherein said auxiliary driver is a hydraulic motor.

16. A mixer apparatus for mixing materials as set forth in claim 1 wherein said auxiliary driver is a hydraulic motor;

said hydraulic motor including:

a hydraulic valve.

17. A mixer apparatus for mixing materials as set forth in claim 16 wherein said hydraulic valve is selectively movable between an on and an off position thereof, so that when said valve is set in said off position, said hydraulic motor is permitted to free wheel.

18. A mixer apparatus for mixing materials as set forth in claim 1 wherein said auxiliary driver is a hydraulic motor;

said hydraulic motor including:

an over running one way drive clutch mechanism that enables the main power source when engaged to over run said auxiliary drive.

19. A mixer apparatus for mixing materials as set forth in claim 18 wherein said over running mechanism includes:

a spline;

a gear splined to said spline for axial movement thereof relative to said spline such that when said over running mechanism is over running, said gear moves axially along said spline from an engaging disposition of said gear to a disengaged disposition of said gear.

20. A mixer apparatus for mixing materials as set forth in claim 1 wherein said auxiliary driver is electrically powered.

21. A mixer apparatus for mixing materials as set forth in claim 1 wherein said auxiliary driver is pneumatically powered.

22. A mixer apparatus for mixing materials as set forth in claim 1 wherein said overrunning device includes:

a mechanism which permits said auxiliary driver to overrun when said auger is being rotated by the main source of power only;

said mechanism including:

a spool valve.

23. A mixer apparatus for mixing feed materials, said apparatus comprising:

a container for the reception therein of the materials;

said container including:

a base;

a wall extending away from said base, said wall defining an opening disposed remote from said base for the reception therethrough of the materials, the arrangement being such that said base and said wall define therebetween an enclosure for the materials received through said opening;

an auger rotatably disposed within said enclosure;

a drive connected to a main source of power, said drive being drivingly connected to said auger;

an auxiliary driver selectively connected to said drive for augmenting rotation of said auger while said auger is being rotated by said main source; and an over running device including:

a mechanism which permits said auxiliary driver to spool when said auger is being rotated by the main source of power only.

24. A mixer apparatus for mixing feed materials, said apparatus comprising:

a container for the reception therein of the materials;

said container including:

a base;

a wall extending away from said base, said wall defining an opening disposed remote from said base for the reception therethrough of the materials, the arrangement being such that said base and said wall define therebetween an enclosure for the materials received through said opening;

an auger rotatably disposed within said enclosure, said auger having an axis of rotation extending through said base;

a driven wheel drivingly connected to said auger, said driven wheel being disposed on an opposite side of said base relative to said auger;

a drive connected to a main source of power, said drive being drivingly connected to said driven wheel so that when said drive rotates, said auger is rotated within said enclosure for mixing the materials;

an auxiliary driver drivingly connected to said driven wheel for augmenting rotation of said auger particularly during a commencement of a mixing operation when additional power is required to rotate said auger and towards an end of a discharge operation so that removal of a residue of the materials disposed on said auger is facilitated;

an over running device associated with the main source of power and said auxiliary driver for enabling over run of the main source of power when said auxiliary driver is engaged and for enabling over run of said auxiliary driver when said auger is being rotated by the main source of power only;

said over running device including:

a mechanism which permits said auxiliary driver to spool when said auger is being rotated by the main source of power only;

said auxiliary driver being a hydraulic motor; and said hydraulic motor including:

a hydraulic valve.

25. A mixer apparatus for mixing feed materials, said apparatus comprising:

a container for the reception therein of the materials;

said container including:

a base;

a wall extending away from said base, said wall defining an opening disposed remote from said base for the reception therethrough of the materials, the arrangement being such that said base and said wall define therebetween an enclosure for the materials received through said opening;

an auger rotatably disposed within said enclosure, said auger having an axis of rotation extending through said base;

a driven wheel drivingly connected to said auger, said driven wheel being disposed on an opposite side of said base relative to said auger;

a drive connected to a main source of power, said drive being drivingly connected to said driven wheel so that when said drive rotates, said auger is rotated within said enclosure for mixing the materials;

an auxiliary driver drivingly connected to said driven wheel for augmenting rotation of said auger particularly during a commencement of a mixing operation when additional power is required to rotate said auger and towards an end of the mixing operation so that removal of a residue of the materials disposed on said auger is facilitated;

an over running device associated with the main source of power and said auxiliary driver for enabling over run of the main source of power when said auxiliary driver is engaged and for enabling over run of said auxiliary driver when said auger is being rotated by the main source of power only;

said auxiliary driver being a hydraulic motor;

said hydraulic motor including:

a closed circuit hydraulic system; and an over running one way drive clutch mechanism.

* * * * *